US006009884A

United States Patent [19]

Suh

[11] Patent Number: 6,009,884

[45] Date of Patent: Jan. 4, 2000

[54] EYELASH CURLER

[76] Inventor: Jeong Joo Suh, 134-2202 Olympic Apt., Bangi-dong, Songpa-ku, Seoul, Rep. of Korea

[21] Appl. No.: 09/271,260

[22] Filed: Mar. 17, 1999

Related U.S. Application Data

[63] Continuation-in-part of application No. 08/749,014, Nov. 14, 1996.

[30] Foreign Application Priority Data

Jan. 31, 1996 [KR] Rep. of Korea ..... 96/2359
Jun. 28, 1996 [KR] Rep. of Korea ..... 96/24771

[51] Int. Cl.[7] ..... A45D 2/48

[52] U.S. Cl. ..... 132/217

[58] Field of Search ..... 132/217, 229, 132/216, 227, 269, 218; 219/227, 228, 229; 606/27, 28, 30

[56] References Cited

U.S. PATENT DOCUMENTS

| | | | |
|---|---|---|---|
| 1,665,327 | 4/1928 | Rissinger . | |
| 1,700,198 | 1/1929 | Dumaine | 219/223 |
| 1,925,266 | 4/1933 | Manning . | |
| 2,630,516 | 8/1953 | Rausch et al. . | |
| 2,675,004 | 4/1954 | Bablon | 132/218 |
| 3,922,521 | 11/1975 | Veigut et al. | 132/229 |
| 4,056,111 | 11/1977 | Mantelet . | |
| 4,212,311 | 7/1980 | Del Valle | 132/217 |
| 4,397,326 | 8/1983 | Formica . | |
| 4,404,977 | 9/1983 | Vasas | 132/218 |
| 4,469,934 | 9/1984 | Isshiki et al. | 132/229 |
| 4,606,342 | 8/1986 | Zamba et al. | 606/30 |
| 4,719,931 | 1/1988 | Suzuki . | |
| 4,939,340 | 7/1990 | Brill | 132/229 |
| 5,086,793 | 2/1992 | Kingsford . | |
| 5,590,669 | 1/1997 | McMullen . | |

FOREIGN PATENT DOCUMENTS

| | | | |
|---|---|---|---|
| 883900 | 7/1943 | France | 132/218 |
| 622876 | 5/1949 | United Kingdom | 132/217 |

*Primary Examiner*—Jeffrey A. Smith
*Assistant Examiner*—Eduardo C. Robert

[57] ABSTRACT

An eyelash curler is provided which lifts and lines up eyelashes during makeup application. A battery is utilized to heat a nichrome wire heat-generation unit which is connected to a heating tube and curls eyelashes easily and handily during make-up application.

9 Claims, 4 Drawing Sheets

EYELASH CURLER

This application is a continuation-in-part of application Ser. No. 08/749,014 filed on Nov. 14, 1996, the entire contents of which are hereby incorporated by reference.

BACKGROUND AND SUMMARY OF THE INVENTION

DESCRIPTION OF THE INVENTION

The present invention relates to an eyelash curler which lifts and lines up eyelashes easily during makeup application. A screw-shaped projecting element (brush type) is connected to the end of the heating tube and a nichrome wire heat-generation unit is disposed within the spiral grooves of the screw-shaped projecting element with the screw-shaped projecting element covering with its screw motion the nichrome wire heat-generation unit.

Generally speaking, the appearance of the eyelash is enhanced by using an eyelash curler in the form of a tweezer or by applying and spreading a liquid over the eyelashes. However, tweezers tend to pull out eyelashes and the use of liquids make eyelashes stiff and can irritate the eyes.

To solve the problems of existing eyelash curlers, the present invention utilizes as a heat-generation unit a nichrome wire which extends through the screw-shaped brush which, in turn, extends from the heat-generation tube. The heat-generation unit is powered by a battery.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
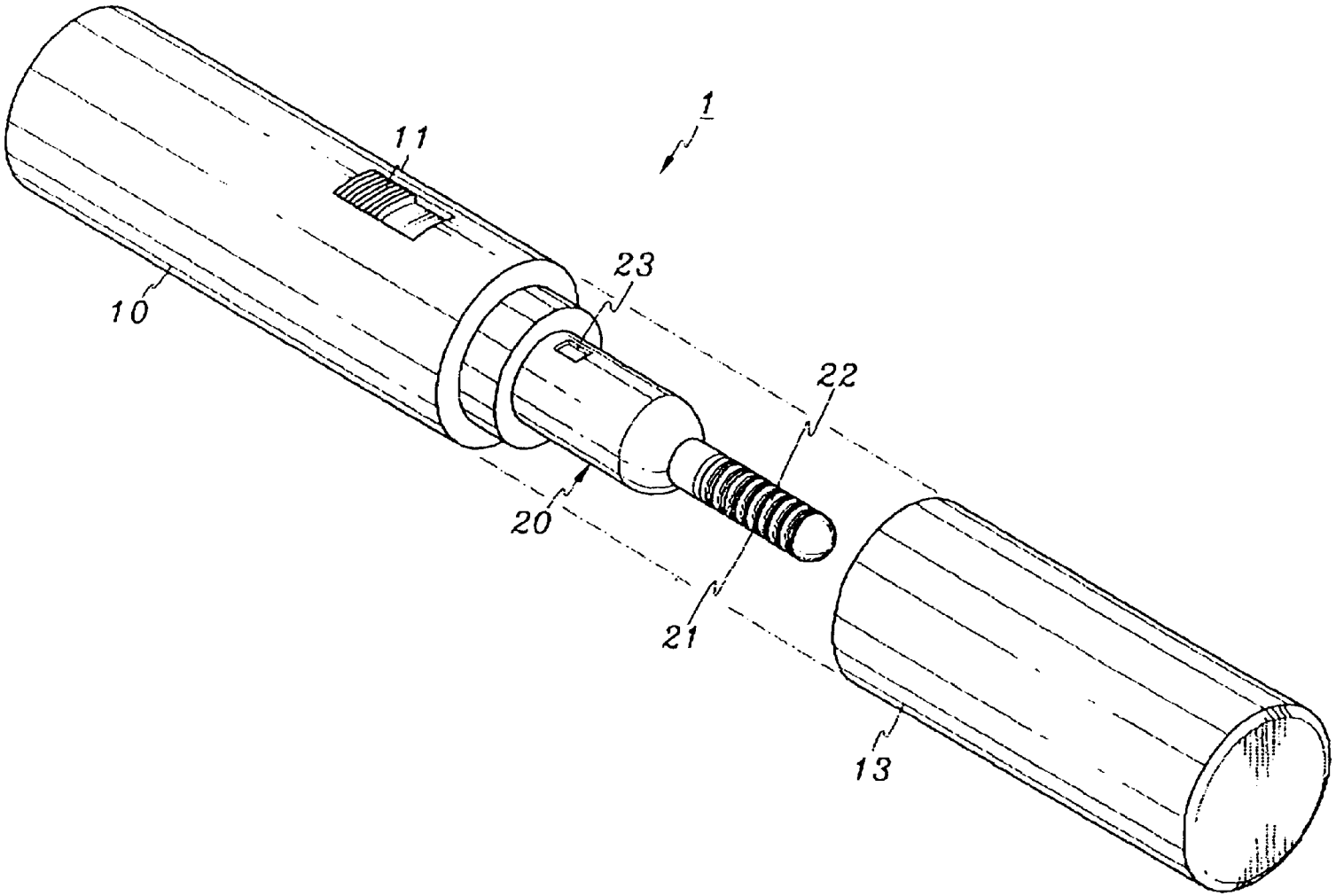
FIG. 1 is a perspective view of the present invention.

The eyelash curler of the present invention comprises a main body 1, containing a handle 10 and a cap 13. A battery 12 is adapted to be disposed in the handle and connected to the heating tube 20 and a switch 11 is positioned on the surface of the handle. A signal lamp 23 is placed on the upper side of the heating tube 20, and a heat-generation unit 21, e.g. a heating wire, is disposed in the screw-shaped curling rod 22, within the screw motion thereof, which screw motion covers the heat-generation unit. The heat-generation unit is also provided with a cap 13 and support 14 in FIG. 2.

Figure 2A:
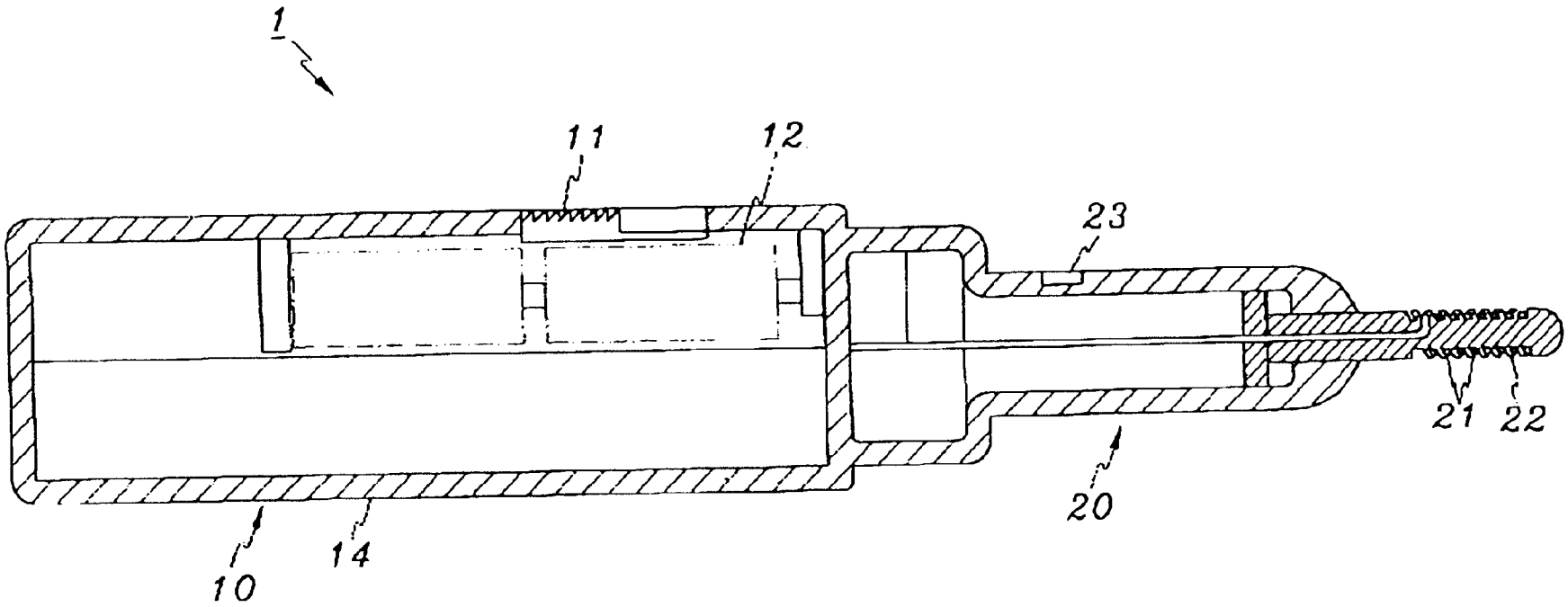
FIG. 2*a* is a longitudinal, sectional view of the present invention.
Figure 2B:
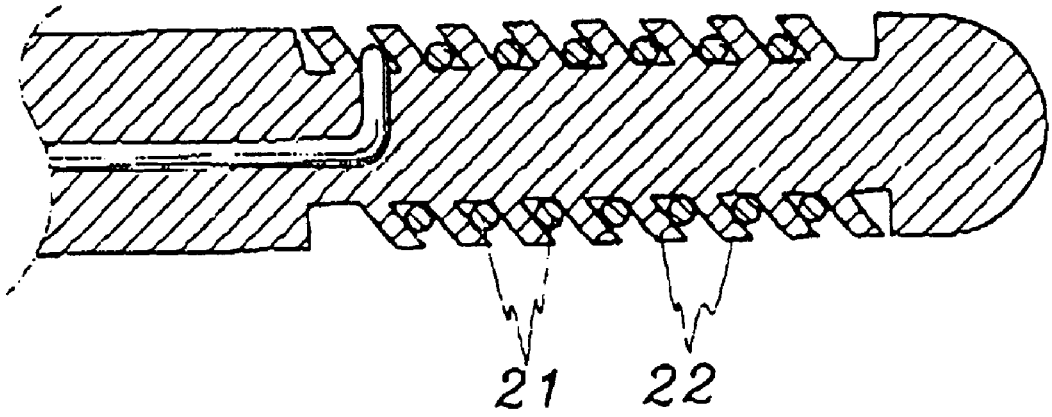
FIG. 2*b* is an exploded view of the curling rod containing the heat-generation unit of the present invention.
Figure 3:
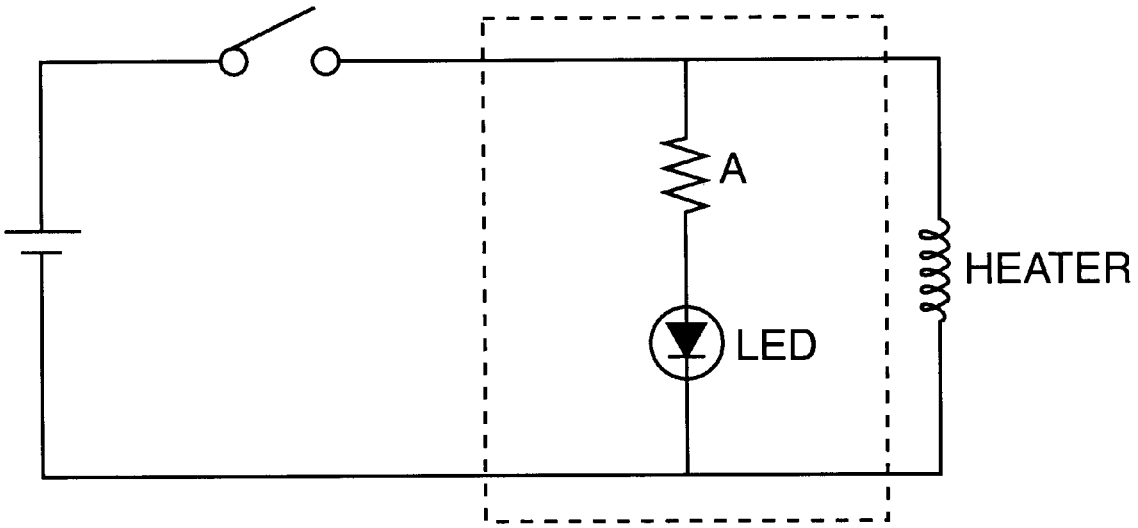
FIG. 3 is an electrical diagram of the signal lamp of the present invention.

The curling rod 22 can be made of either engineering plastic or a brush-type material. The present invention is used for lifting eyelashes. As shown in FIG. 2, after opening the cap 13 of the main body 1, the switch 11 is operated by placing the supporter 14 in the hand. The electric power is turned on by the switch which, in turn, lights the signal lamp 23 on the upper side of the heating tube 20. The battery also supplies electricity to the nichrome wire heat generation unit. The heat-generation unit is heated and the designated temperature is transferred to the brush which is used to lift the eyelashes, relying upon the heat, thereby lining up the eyelashes naturally. Because the heat-generating unit, i.e., the nichrome wire is covered by or is overlapped by the screw motion of the thread, the eyelashes are protected from direct contact with the heat-generating unit thereby avoiding damage or singing of the eyelashes. Thus, the groove created by the screw motion of the thread can be coated so that the nichrome wire, when disposed in the thread, is overlapped by the thread at the surface of the curling rod but still maintains open access to the surface of the curling rod for transferring heat thereto.

Advantageously, the nichrome wire has a length of 7–10 cm and a thickness of 0.1–0.3 cm. Although nichrome wire is used as the heat-generation unit, other types of heating elements can be utilized.

After the switch 11 is on for about 4–10 minutes, the eyelash curler of the present invention is heated and maintained at a temperature of between 65–70° C. which gives the proper curling condition without burning the eyelashes. For this purpose, a 1.5 volt alkaline battery can be used as the source of power.

Further, by forming the curling rod 22 on the outer surface of the heat-generation unit 21, the heat-generation unit does not directly contact the skin. Also, it is easy to apply because it is portable and small and requires only one battery. Therefore, it can be used whenever and wherever needed. Thus, the present invention curls the eyelashes easily and naturally by utilizing a heat-generating element disposed in a heat-generation unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An eyelash curler comprising:

a handle, a heat-generating unit attached to said handle, said heat-generating unit containing spiral grooves which advance along the surface of the heat-generating unit, and a heat-generating element disposed within and overlapped by the spiral grooves of said heat-generating unit.

2. The eyelash curler of claim 1, wherein the heat-generating element is a nichrome wire.

3. The eyelash curler of claim 2, wherein the nichrome wire has a length of 7 to 10 cm and a thickness of 0.1 to 0.3 cm.

4. The eyelash curler of claim 1, wherein a battery is operatively connected to the heat-generating element for providing electrical power thereto.

5. The eyelash curler of claim 4, wherein a signal light is operatively connected to the battery and the heat-generating element for indicating when the electrical power is being transferred to the heat-generating element.

6. The eyelash curler of claim 5, wherein a switch is provided for connecting or disconnecting the electrical power to the signal light and the heat-generating element.

7. The eyelash curler of claim 6, wherein upon turning the switch to an "ON" position, a temperature of between 65–70° C. is reached and maintained within 4–10 minutes.

8. The eyelash curler of claim 1, wherein the heat-generating unit is in the form of a curling rod.

9. The eyelash curler of claim 8, wherein the curling rod is made of plastic or a brush-type material.

* * * * *